US011448205B2

(12) United States Patent
Meinz et al.

(10) Patent No.: US 11,448,205 B2
(45) Date of Patent: Sep. 20, 2022

(54) DIAPHRAGM PUMP COMPRISING A DIAPHRAGM CONNECTED TO A CONTROL ELEMENT AND A PRESSURE PROTECTION DEVICE MOUNTED TO THE CONTROL ELEMENT WHEREIN THE CONTROL ELEMENT IS INTERMEDIATE THE CONTROL ELEMENT AND THE DIAPHRAGM AND IS CONFIGURED TO SEAL AGAINST A TRANSFER CHAMBER WALL

(71) Applicant: Wanner Engineering, Inc., Minneapolis, MN (US)

(72) Inventors: Peter Meinz, Minneapolis, MN (US); Dustin Featherstone, Hastings, MN (US); Matthew Hollister, Hudson, WI (US); Aaron Jarkko Kariniemi, Plymouth, MN (US)

(73) Assignee: Wanner Engineering, Inc., Minneapolis, MN (US)

( * ) Notice: Subject to any disclaimer, the term of this patent is extended or adjusted under 35 U.S.C. 154(b) by 392 days.

(21) Appl. No.: 16/387,295

(22) Filed: Apr. 17, 2019

(65) Prior Publication Data

US 2019/0323493 A1 Oct. 24, 2019

Related U.S. Application Data

(60) Provisional application No. 62/659,550, filed on Apr. 18, 2018.

(51) Int. Cl.
*F04B 43/067* (2006.01)
*F04B 53/00* (2006.01)

(52) U.S. Cl.
CPC ..... *F04B 43/067* (2013.01); *F04B 53/00* (2013.01); *F04B 53/006* (2013.01); *F04B 2205/064* (2013.01)

(58) Field of Classification Search
CPC ..... F04B 43/067; F04B 43/0081; F04B 2205/064; F04B 43/0063; F04B 45/0333;
(Continued)

(56) References Cited

U.S. PATENT DOCUMENTS 1,788,886 A * 1/1931 Nutt ..... F02M 37/04 417/388
2,919,650 A * 1/1960 Wiggermann ..... F04B 43/0054 417/386
(Continued)

FOREIGN PATENT DOCUMENTS

| | | |
|---|---|---|
| CA | 2445585 | 11/2002 |
| EP | 1 291 524 A2 | 3/2003 |
| EP | 2639455 | 9/2013 |

OTHER PUBLICATIONS

International Search Report and Written Opinion for Application No. PCT/US2019/027944 dated Jun. 19, 2019.

*Primary Examiner* — Kenneth J Hansen
*Assistant Examiner* — Benjamin Doyle
(74) *Attorney, Agent, or Firm* — Merchant & Gould P.C.

(57) ABSTRACT

A diaphragm pump includes a transfer chamber containing hydraulic fluid and a pumping chamber for fluid to be pumped. A connecting assembly includes a plunger extending to the transfer chamber. A diaphragm connects to the connecting assembly and separates the transfer chamber and the pumping chamber. A pressure protection device mounts to the connecting assembly and is configured to seal against the transfer chamber when pressure differential, including reverse pressure differential, across the diaphragm exceeds a predetermined value. The pressure protection device is intermediate the plunger and the diaphragm and supports the diaphragm when there is excess pressure differential across the diaphragm.

20 Claims, 9 Drawing Sheets

(58) Field of Classification Search
CPC ..... F04B 53/00; F04B 53/006; F04B 53/16; F05B 2210/11; F05B 2280/4003
USPC ..... 417/388
See application file for complete search history.

(56) References Cited

U.S. PATENT DOCUMENTS 2,948,223 A * 8/1960 Mashinter ..... F04B 43/0054 417/387
3,075,468 A * 1/1963 Eifel ..... F04B 53/06 417/388
3,093,086 A 6/1963 Altoz et al.
3,254,845 A * 6/1966 Schlosser ..... H01J 19/00 239/332
3,354,831 A * 11/1967 Acker ..... F04B 43/026 417/387
3,367,270 A * 2/1968 Schlosser ..... F04B 43/067 417/388
4,781,535 A 11/1988 Frawley et al.
5,246,351 A * 9/1993 Horn ..... F04B 43/067 417/387
5,263,827 A * 11/1993 Esposito ..... F04B 43/06 417/395
5,535,987 A 7/1996 Wlodarczyk
5,707,219 A * 1/1998 Powers ..... F04B 43/067 417/386
5,894,784 A 4/1999 Bobbitt, III et al.
5,899,671 A * 5/1999 Horn ..... F04B 43/009 417/387
6,071,089 A * 6/2000 Maier ..... F02M 59/14 417/386
6,094,970 A 8/2000 Sprenger et al.
6,582,206 B2 6/2003 Schluecker
6,884,045 B2 4/2005 Kohlhase et al.
6,899,530 B2 5/2005 Lehrke et al.
6,941,853 B2 9/2005 Hembree
7,201,097 B2 4/2007 De Koning
7,467,582 B2 12/2008 Hembree
7,905,172 B2 3/2011 Ohrle et al.
2001/0050040 A1 12/2001 Shimizu
2015/0118078 A1* 4/2015 Hembree ..... F04B 53/22 417/382
2015/0167853 A1 6/2015 Obara
2015/0300491 A1 10/2015 Teshima
2016/0123313 A1 5/2016 Simmons
2016/0123319 A1* 5/2016 Hembree ..... F04B 43/067 417/398
2016/0230752 A1 8/2016 Suzuki

* cited by examiner

DIAPHRAGM PUMP COMPRISING A DIAPHRAGM CONNECTED TO A CONTROL ELEMENT AND A PRESSURE PROTECTION DEVICE MOUNTED TO THE CONTROL ELEMENT WHEREIN THE CONTROL ELEMENT IS INTERMEDIATE THE CONTROL ELEMENT AND THE DIAPHRAGM AND IS CONFIGURED TO SEAL AGAINST A TRANSFER CHAMBER WALL

BACKGROUND OF THE INVENTION

Field of the Invention

The present invention relates to a system and method for protecting the diaphragm and the crankcase in a diaphragm pump from excess differential pressure and to a diaphragm pump with a pressure protection device.

Prior Art

Diaphragm pumps operate by displacing the pumped fluid with a diaphragm. In such hydraulically driven pumps, the diaphragm is deflected by hydraulic fluid pressure forced against the diaphragm. Such pumps have proven to provide a superior combination of value, efficiency and reliability. However, maintaining a proper seal and extending the life of the diaphragm are challenges with diaphragm pumps.

During normal operation, the pump's propulsion and control systems prevent or limit large differential pressures across the diaphragm or limit the diaphragm's exposure to such pressures and additional diaphragm protection is not necessary. However, for some applications the diaphragm may be subjected to large reverse differential pressures. Both high suction pressures and high discharge pressures that are sustained when the pump is not in operation may create large reverse differential pressures across the diaphragm. These reverse differential pressures may damage the diaphragm at locations where the diaphragm is pressed against surrounding structures to such a degree that the diaphragm conforms to the discontinuities from materials and/or the pump geometry. Gaps, edges and material transitions engaged by a deformed diaphragm are likely target areas for stress and damage. Such damage may lead to rupture of the diaphragm and pump failure. Moreover, should the diaphragm rupture and the system pressure remains, system fluid may pass through the ruptured diaphragm into the pump's hydraulic transfer chamber. If the problem is not remedied, eventually system fluid may enter the crankcase and possibly damage the pump.

It can be seen then that a new and improved diaphragm pump including a diaphragm with a pressure protection device is required. Such an improved pump and diaphragm arrangement should prevent or limit the damage to the diaphragm due to high-pressure differentials across the diaphragm including excessive reverse pressure differentials. Furthermore, an improved pump and diaphragm should prevent fluid from entering the hydraulic back end of the pump should the diaphragm rupture. In addition, such a system should be simple to manufacture and install without increasing the size of the pump or affecting performance. The present invention addresses these problems as well as others associated with diaphragm pumps and diaphragm sealing arrangements.

SUMMARY OF THE INVENTION

The present invention is directed to a system for protecting a diaphragm in a diaphragm pump from excess differential pressure across the diaphragm and to a diaphragm pump with a pressure protection device.

A diaphragm pump includes a diaphragm assembly moving in a reciprocating motion that flexes a diaphragm between the pumping chamber and hydraulic fluid chamber. The diaphragm moves back and forth between a retracted position and an extended position to pump the fluid in the pumping chamber.

A diaphragm assembly includes the diaphragm element mounted to a control element including a control element shaft portion and a control element disc portion. A fastener engages a disc shaped follower to mount the diaphragm to the control element. The diaphragm element engages and seals against a hydraulic housing. The control element shaft is also in contact with a spring that applies a force against the hydraulic housing and forces the diaphragm to its retracted position. The spring is generally used to create a small bias pressure across the diaphragm when the pump is operating. Moreover, the spring will also pull the diaphragm back to a resting position when the pump is idle. In one embodiment, the hydraulic housing defines a center opening through which the plunger may extend and an inner radially extending planar portion leading to an obliquely angled portion and an outer portion having a radially extending surface. A manifold housing is formed as an annular element with a center opening and engages the hydraulic housing. The hydraulic housing together with the manifold housing creates a transfer chamber around the diaphragm assembly. The diaphragm assembly moves in the transfer chamber formed between the hydraulic housing and the manifold housing.

In a conventional diaphragm pumps, should an over pressure situation occur, the high pressure from the pump fluid forces the diaphragm into any gap on the hydraulic housing side of the diaphragm. However, the present invention utilizes a pressure differential protection device that mounts to the diaphragm assembly against the control element and the diaphragm. The protection device provides a smooth transition and continuous surface between the angled portion of the hydraulic housing and the disc portion of the control element and eliminates gaps and crevices that the diaphragm may be forced into. Therefore, even if excessive pressures are encountered, the backup device does not allow the diaphragm element to deform into a discontinuity and maintains a continuously smooth configuration. The backup device has a further benefit as it also acts as a seal to prevent fluid from entering the transfer chamber if the diaphragm should leak. The protective backup device is made of an elastomeric material to avoid metal-to-metal contact and possible leakage. Suitable materials include, but are limited to ultra-high-molecular-weight polyethylene, urethane and rubber. The elastomeric material is able to maintain an effective seal even over a lengthy idle period and provide protection for the hydraulic transfer chamber and crankcase from system fluid.

The pressure differential protection device is shaped to match the shape of the diaphragm and may be round, oval or "race track" shaped. A planar portion that may be substantially continuous with a small center-mounting opening or may be substantially open, depending on the configuration of the pump. A lip or flange extends around a periphery of the planar portion to provide support and engagement with the diaphragm element and to fill the gap and provide a smooth and continuous support surface for the diaphragm from the control element to the hydraulic housing. It can be appreciated that the protection device may have multiple configurations such as a disc or an annular element and may be formed of various materials that provide proper support.

The protection device preferably has a higher stiffness than the diaphragm element so that the protection device provides proper support while not flexing back and forth in a reciprocating manner as the diaphragm is designed to do. It can also be appreciated that the lip or flange may be configured to match the general geometry of the surrounding elements to provide proper and continuous support for the diaphragm element and avoid sharp directional changes in the diaphragm element when subjected to a high-pressure reverse differential condition.

An embodiment of the pressure differential protection device may be configured with an annular disc portion and configured as a washer or disc to provide engagement with the hydraulic housing in a continuous support surface so that the diaphragm element cannot be forced into the gap where stresses might develop. It can also be appreciated that the protection devices and may have dimensions and/or lips and edges that are adapted to mate with the particular configuration of the diaphragm pump to provide support for the diaphragm element and to eliminate gaps and crevices.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like references letters and numerals indicate corresponding structure throughout the several views.

DETAILED DESCRIPTION OF THE PREFERRED EMBODIMENT

Figure 1:
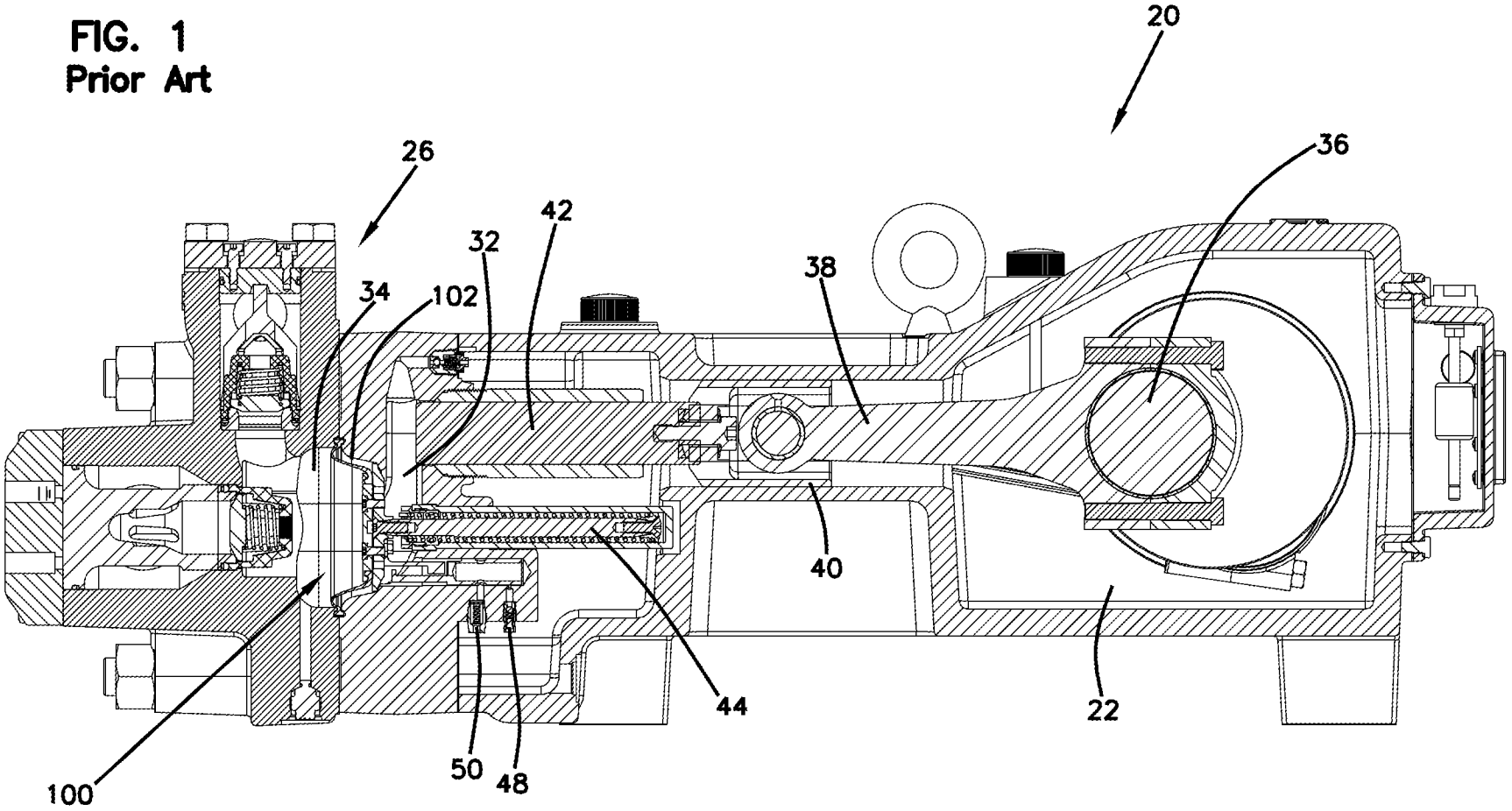
FIG. 1 Prior Art
FIG. 1 is a side sectional view of a diaphragm pump.

Referring now to the drawings and in particular to FIG. 1, there is shown a hydraulically driven diaphragm pump, generally designated (20). The diaphragm pump (20) is driven by a crankshaft (36) mounted in a crankcase (22). A manifold (26) includes an inlet passage (74) and a discharge passage (76). The manifold (26) also includes one or more inlet check valves (72) and one or more discharge check valves (70).

Figure 2:
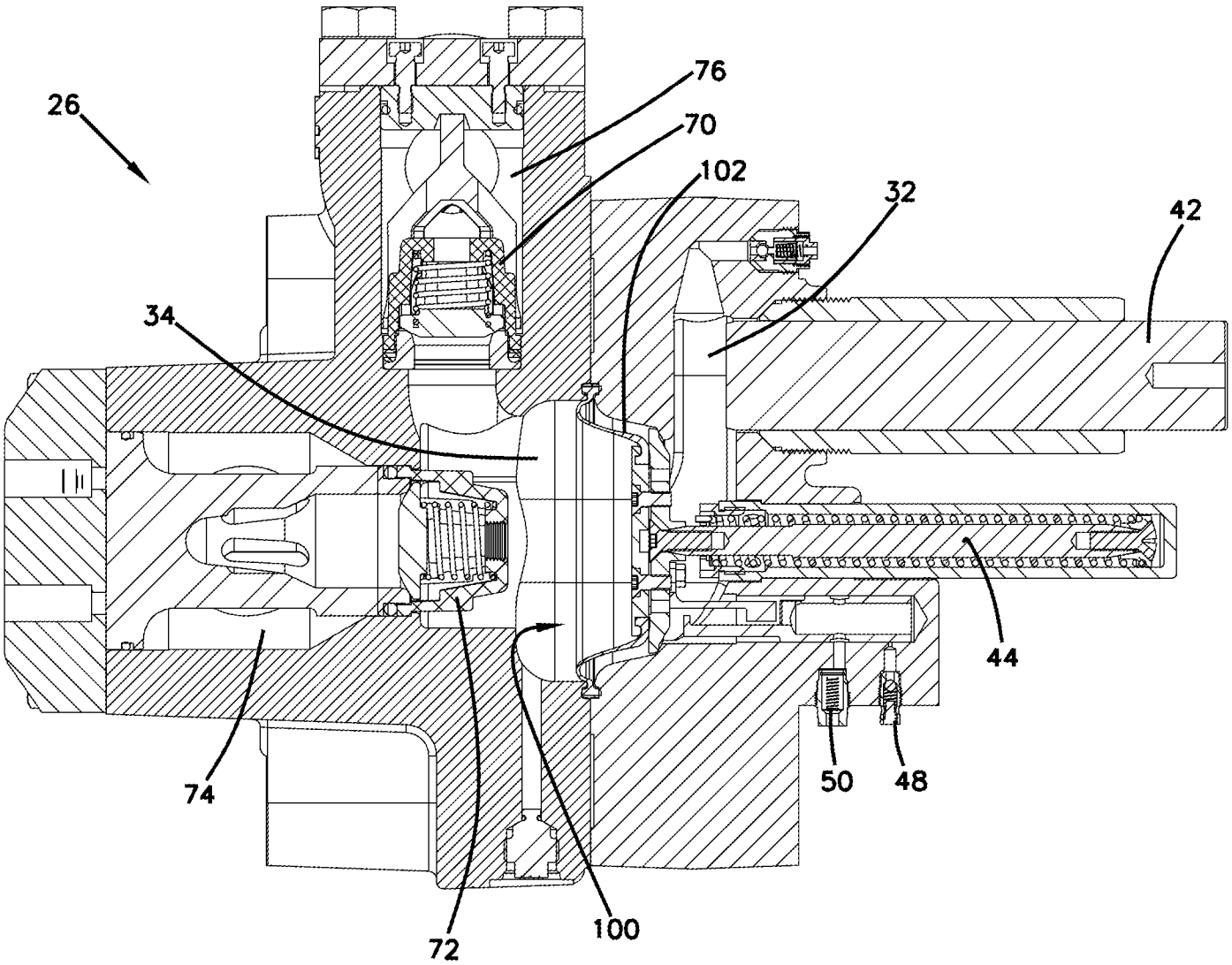
FIG. 2 Prior Art
FIG. 2 is a side sectional view of a plunger, diaphragm, pumping chamber and manifold for the diaphragm pump shown in FIG. 1.

In the embodiment shown, the pump (20) is a diaphragm pump and includes a diaphragm assembly (100) mounted on a valve stem (44) as shown more clearly in FIG. 2. The diaphragm assembly (100) includes a flexible diaphragm element (102) and is hydraulically driven by a plunger (42) connected to a slider (40) on a crankshaft rod (38) to the crankshaft (36). The plunger (42) extends into a hydraulic fluid chamber (32) and drives hydraulic fluid against the diaphragm. An overfill check valve (48) and an underfill check valve (50) maintain proper hydraulic fluid levels.

The diaphragm (102) receives fluid in a pumping chamber (34) and the system fluid is pumped while the diaphragm (102) deflects back and forth between an extended position and a fully retracted position. The manifold (26) includes a separate inlet check valve (72) and discharge check valves (70) for each pumping chamber in multiple diaphragm pumps.

Figure 3:
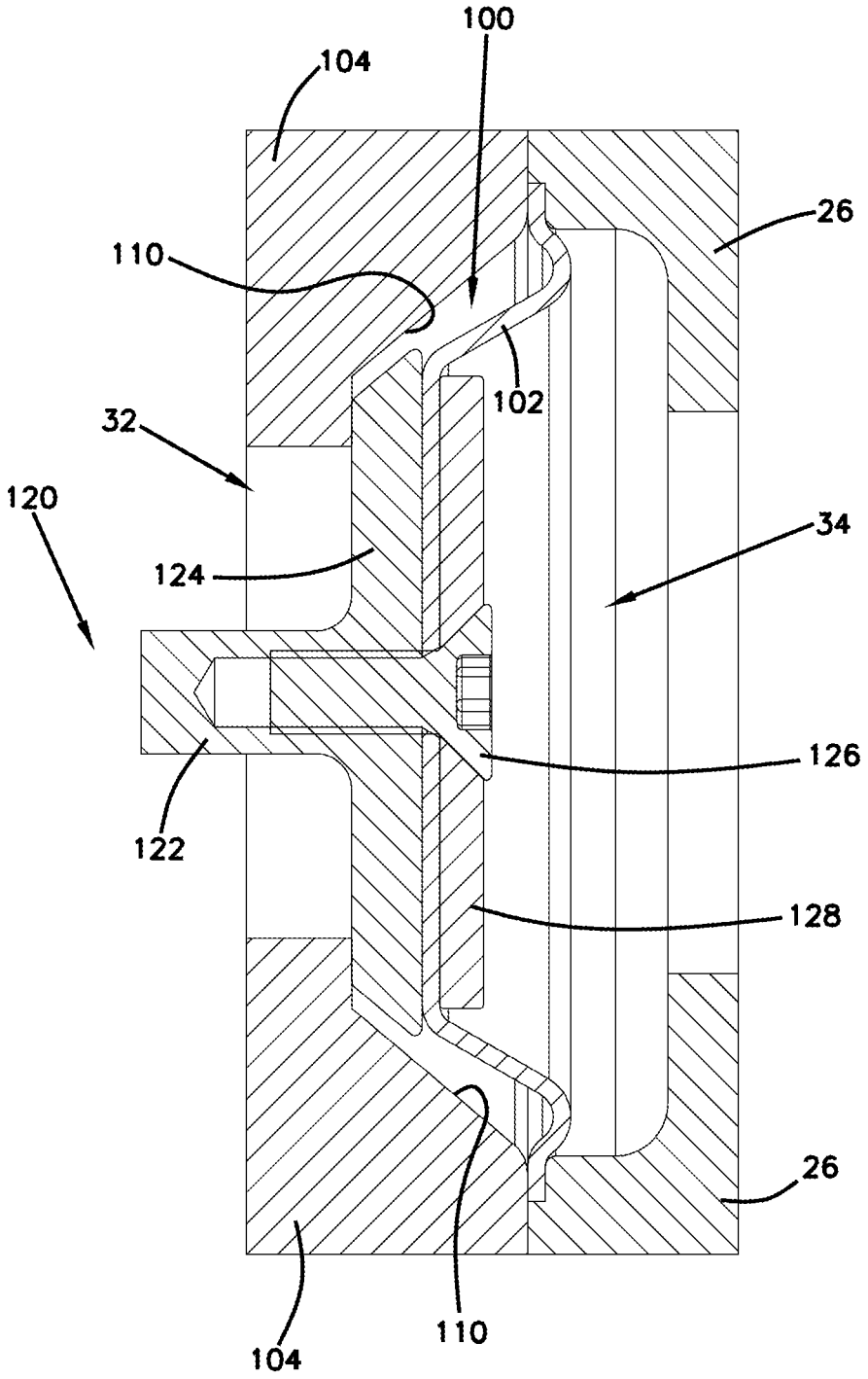
FIG. 3 Prior Art
FIG. 3 is a side sectional view of the diaphragm shown in FIG. 2 with the diaphragm at bottom dead center with normal bias pressure.
Figure 4:
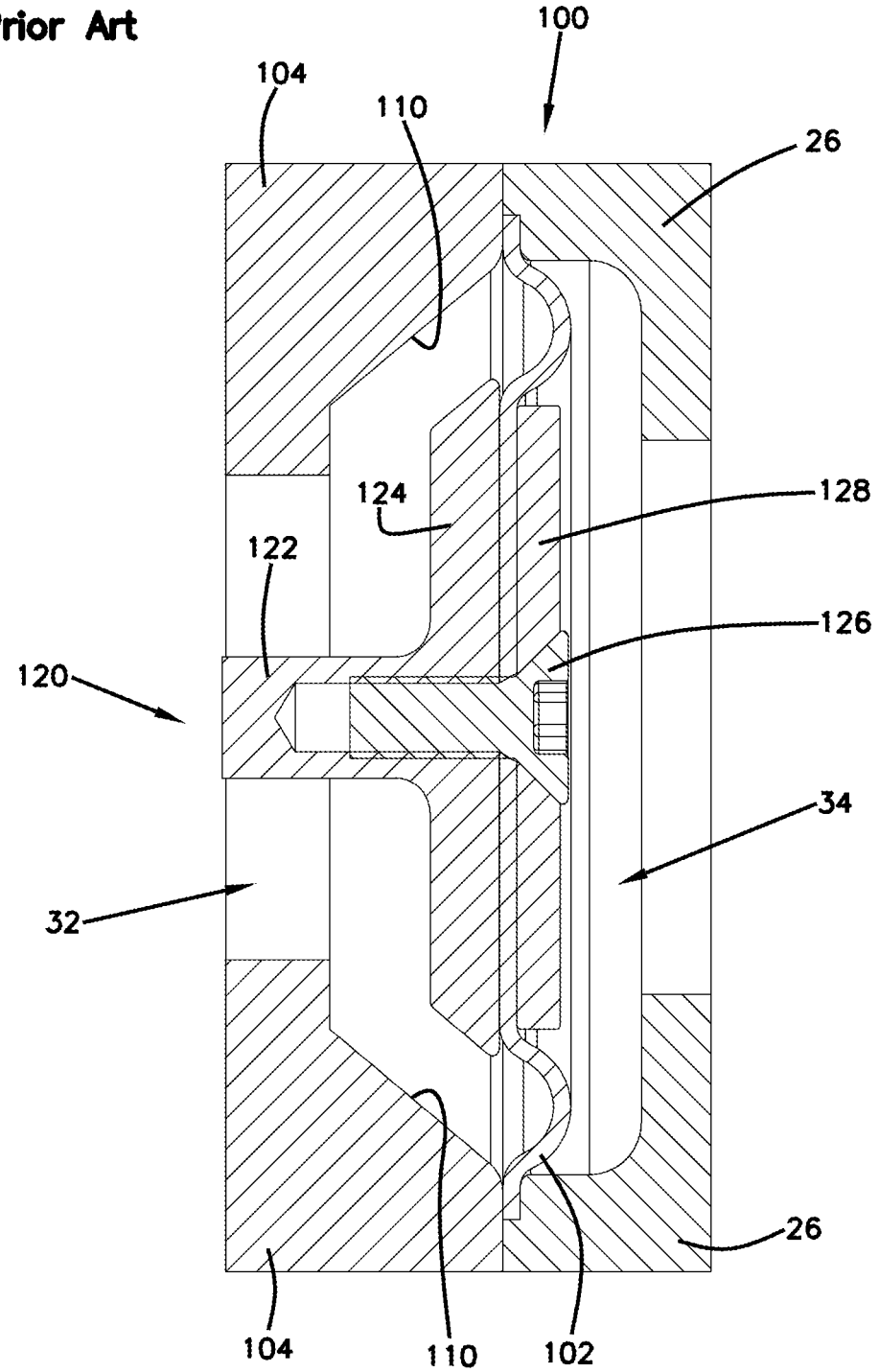
FIG. 4 Prior Art
FIG. 4 is a side sectional view of the diaphragm shown in FIG. 3 with the diaphragm in an extended position with normal bias pressure.
Figure 5:
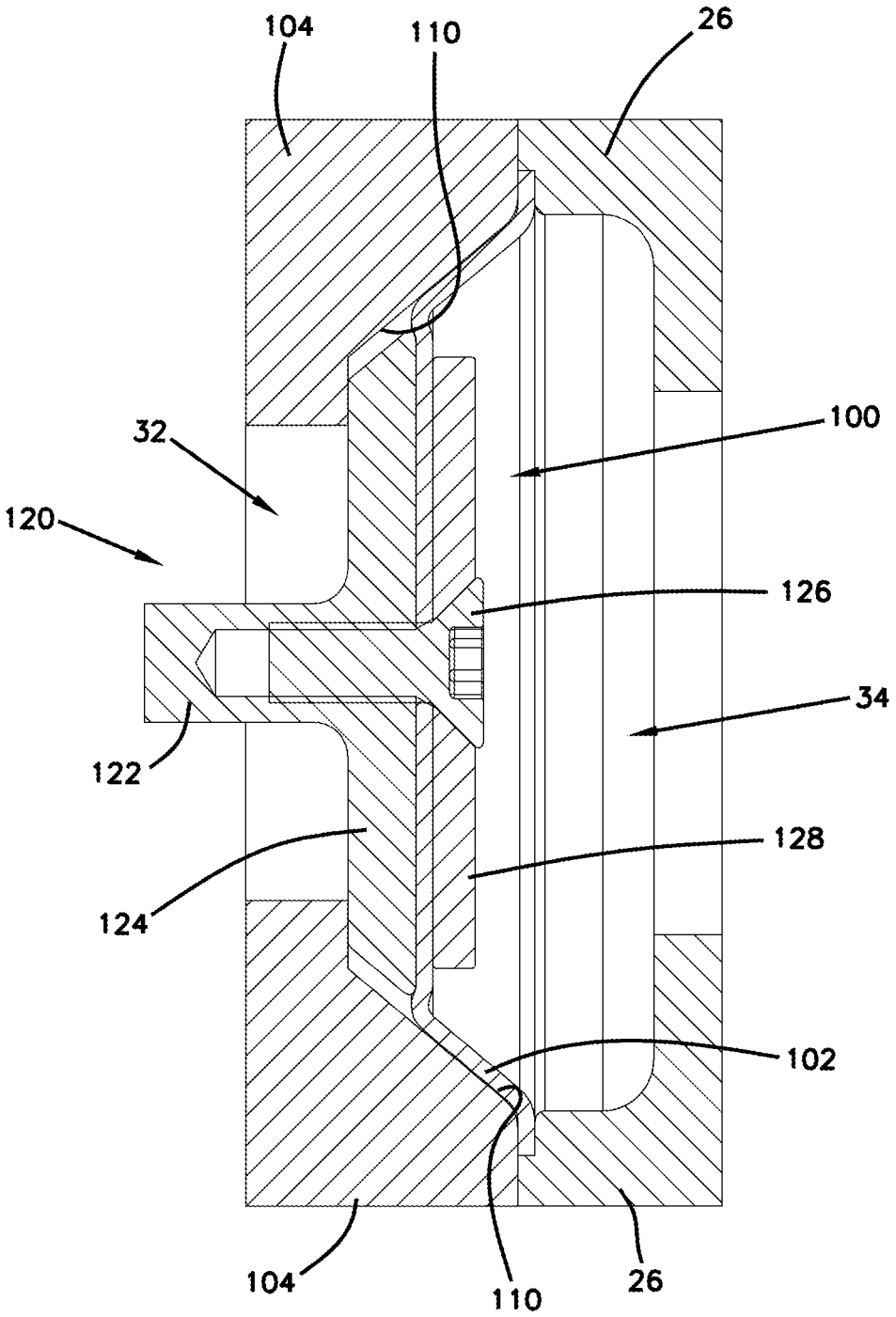
FIG. 5 Prior Art
FIG. 5 is a side sectional view of the diaphragm shown in FIG. 3 with the diaphragm deformed from reverse differential pressure.

Referring now to FIGS. 3-5 the diaphragm assembly (100) has a reciprocating motion to flex the diaphragm (102) between the pumping chamber (34) and the hydraulic fluid chamber (32). During operation, the diaphragm element (102) reciprocates along a central axis between a retracted position as shown in FIG. 3, and an extended position as shown in FIG. 4. The hydraulic fluid chamber (32) is at least partially defined by a hydraulic housing (104) including an angled portion (110).

As shown in FIG. 5, it can be appreciated that with a conventional diaphragm, should an excess reverse pressure differential situation occur, the pressure from the pumped fluid forces the diaphragm element into a discontinuity between the hydraulic housing (104), in particular the angled portion (110), and the disc shaped portion (124) of the control element (120). Such a deformation into the gap stresses the diaphragm element (102) and may lead to damage and/or failure of the diaphragm element (102) as discussed above.

Figure 7:
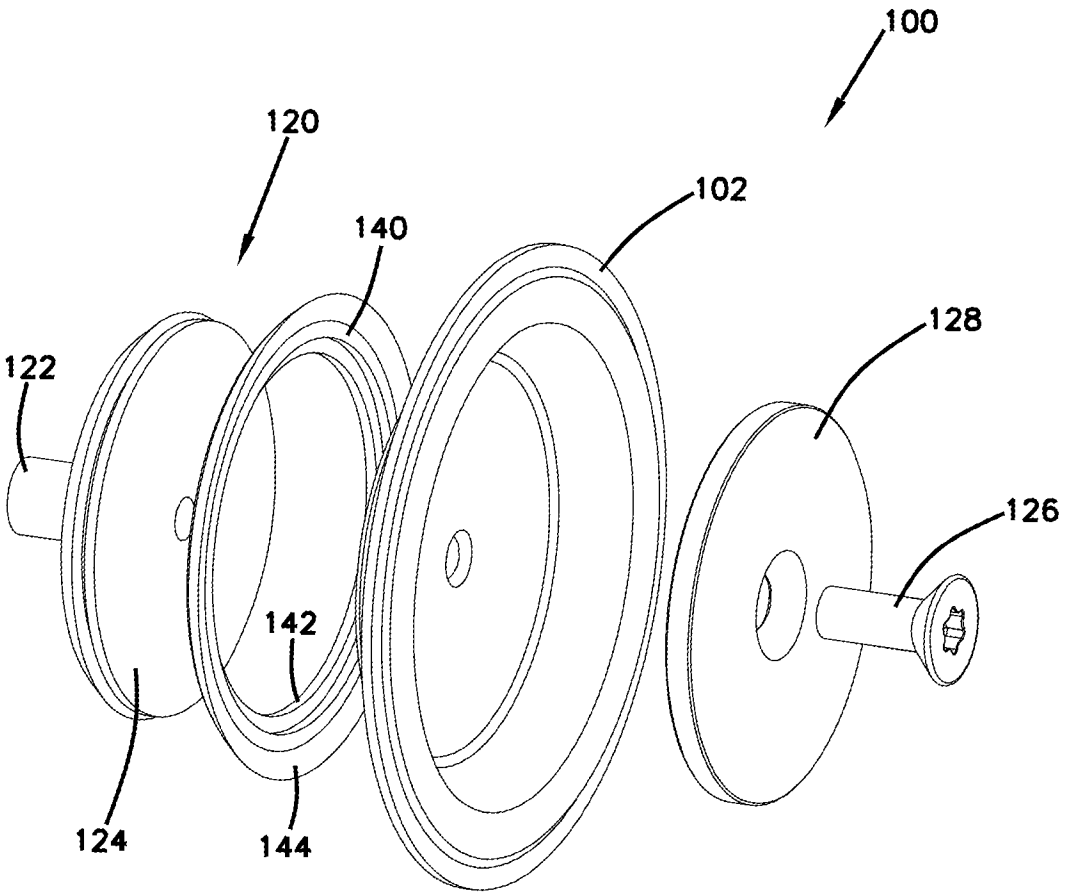
FIG. 7 is an exploded perspective view of the diaphragm assembly with the pressure differential protection device shown in FIG. 6.

As shown in FIG. 7, the diaphragm assembly (100) has the diaphragm element (102) mounted to a control element (120) including the control element shaft portion (122) and the control element disc portion (124). The fastener (126) engages the disc shaped follower (128) to mount the diaphragm (102) to the control element (120). The diaphragm engages the hydraulic housing on the hydraulic chamber side of the diaphragm.

Figure 6:
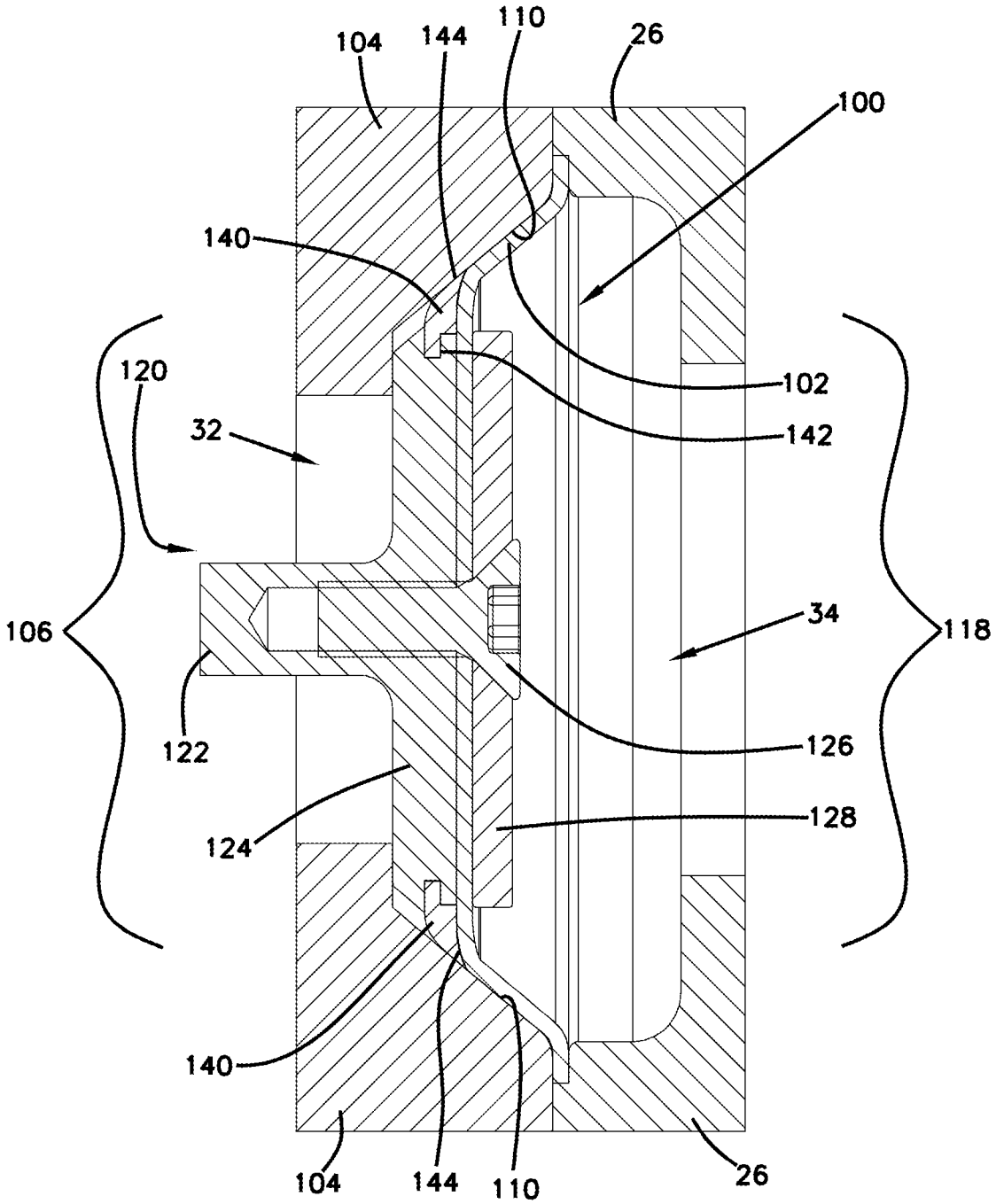
FIG. 6 is a side sectional view of the diaphragm shown in FIG. 2 with a pressure differential protection device according to the principles of the present invention.

As shown in FIGS. 6 and 7, the present invention utilizes a pressure differential protection device (140) that mounts to the diaphragm assembly (100) against the control element (120) and the diaphragm (102). The control element disc portion (124) may include a groove to receive the protection device (140) if configured as a ring type element. The protection device (140) creates a diaphragm engagement surface that provides a smooth transition and continuous support surface along the angled portion (110) of the hydraulic housing (104) and the disc portion (124) of the control element (120). Therefore, even if excessive reverse differential pressures are encountered, the backup device (140) does not allow the diaphragm element (102) to deform into a gap and supports and maintains the diaphragm element in a configuration as shown in FIG. 6. Therefore, diaphragm (102) avoids folds and/or deformations that could concentrate stresses and damage the diaphragm element (102). Furthermore, it can be appreciated that the protection device (140) prevents fluid from entering the transfer chamber and crankcase should the diaphragm (102) rupture or leak.

The embodiment of the pressure differential protection device (140) shown in FIGS. 6 and 7 is a molded ring type element of a material that provides sufficient support for the diaphragm element (102). An inner mounting portion (142) seats against the control element (120). A lip or flange (144) at the periphery of the pressure differential protection device (140 prevents a void and provides smooth and continuous support surface for the diaphragm from the control element (120) to the hydraulic housing (104) even under excess reverse pressure differential. The protection device (140) may be formed of various materials, such as ultra-high-molecular-weight polyethylene, urethane, rubber and other elastomeric materials that provide proper support and maintain a seal under pressure for extended periods. The protection device (140) preferably has a higher stiffness than the diaphragm element (102) so that the protection device (140) does not flex back and forth in a reciprocating manner with the diaphragm (102).

It can be appreciated that the protection device (140) may have multiple configurations such as a disc or an annular element. Moreover, the periphery of the protection device may be round, oval or "race track" shaped. The surfaces of the lip or flange (144) that do not engage the diaphragm may be configured to match the general geometry of the surrounding pump elements to provide proper and continuous support for the diaphragm element (140).

Figure 8:
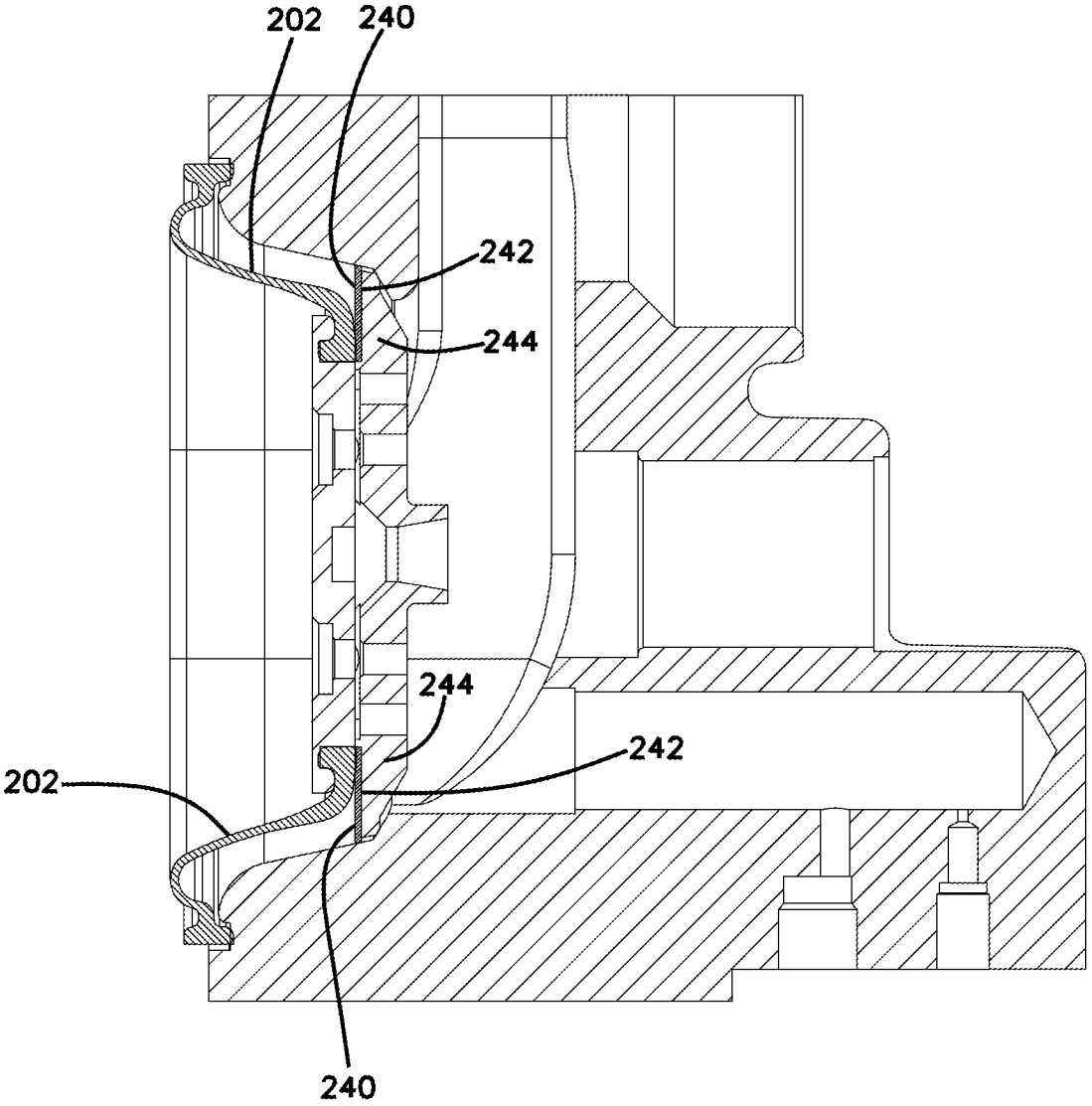
FIG. 8 is a sectional view of an alternate embodiment of a pressure differential protection device according to the principles of the present invention.

Referring now to FIG. 8, there is shown an alternate embodiment of a pressure differential protection device. A pressure differential protection device, generally designated (240) is for a diaphragm (202). The pressure differential protection device (240) is generally configured with a washer like annular planar disc portion (242) and configured to provide engagement with the hydraulic housing as a continuous support surface without gaps. The pressure differential device (240) includes a support portion (244) on the back of the disc portion (242) to ensure that the planar disc portion maintains its shape and maintains a seal even when subjected to excess reverse pressure differentials. As with the other embodiments, gaps into which the diaphragm element (202) might otherwise deform are eliminated. The pressure differential protection device (240) covers irregularities in the surface of the hydraulic chamber to provide a smoother continuous support surface against the hydraulic manifold. It can also be appreciated that the protection devices (140 and 240) may have sizes and dimensions that are varied to mate with the particular configuration of the diaphragm pump and the hydraulic chamber to provide support for the diaphragm element (102).

Figure 9:
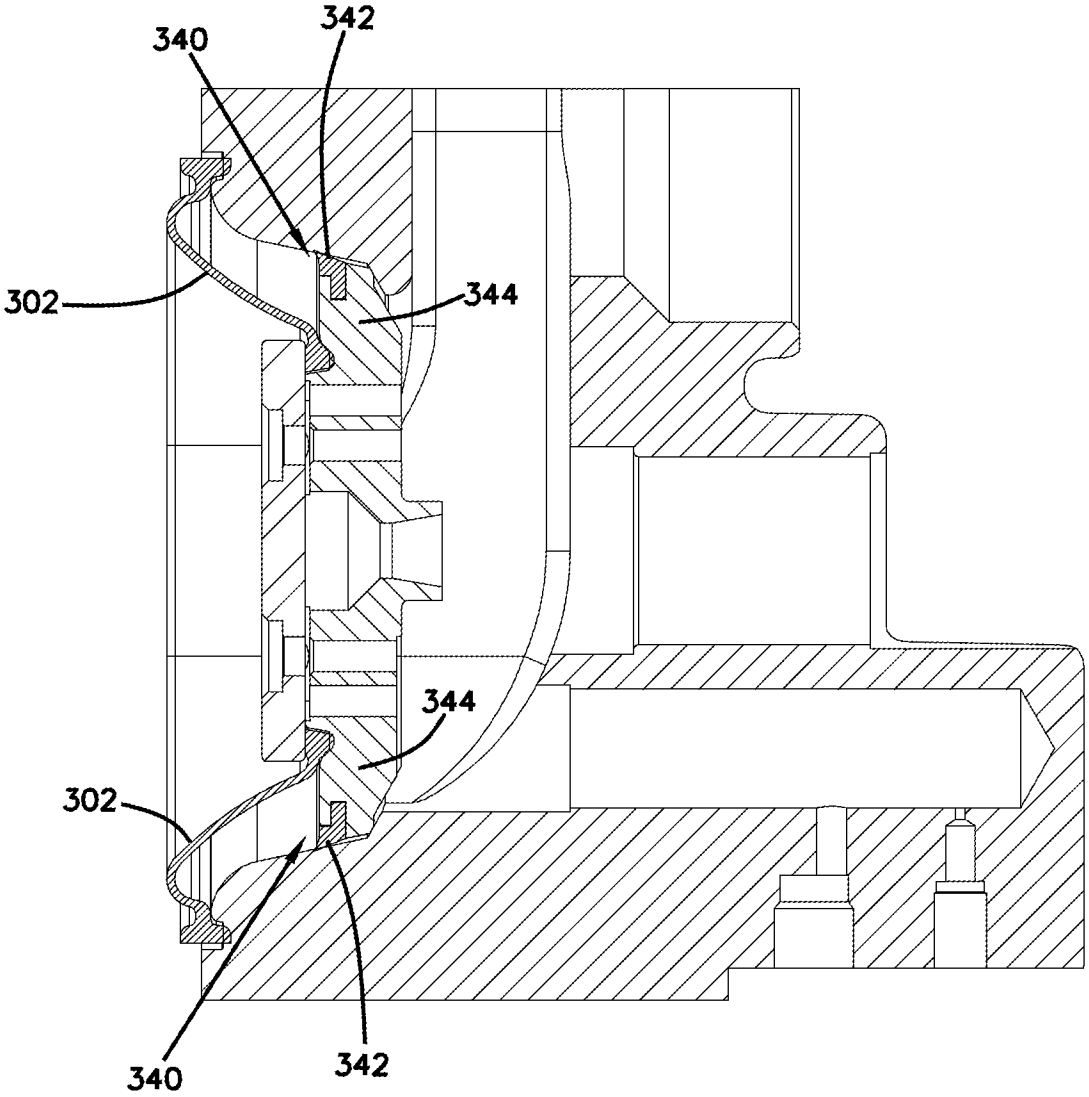
FIG. 9 is a sectional view of a further alternate embodiment of a pressure differential protection device according to the principles of the present invention.

Referring now to FIG. 9, there is shown a further alternate embodiment of a pressure differential protection device. A pressure differential protection device, generally designated (340) is configured for a diaphragm (302). The pressure differential protection device (340) includes a ring type element (342) and that is configured to provide engagement with the hydraulic housing in a continuous support surface without gaps. The ring type element (340) may be molded and mounted to a support portion (344) that provides for retaining and supporting the ring type element (342) to ensure that the pressure differential protection device (340) maintains its shape and maintains a seal even when subjected to excess reverse pressure differentials. As with the other embodiments, gaps into which the diaphragm element (302) might otherwise deform are eliminated. The pressure differential protection device (340) covers irregularities and discontinuities in the surface of the hydraulic chamber to provide a smoother continuous support surface against the hydraulic chamber.

As with the previously discussed protection devices (140, 240), it can be appreciated that the protection device (340) may be configured to have sizes and dimensions that are varied to mate with the particular configuration of the diaphragm pump and the dimensions and shape of hydraulic chamber to provide support for the diaphragm element. Moreover, the general geometry of the protection device of the present invention may be varied and configured so as to be complementary to the walls of the surrounding chamber to form continuous gap free surfaces without sharp angles or transitions between surfaces and to maintain proper sealing to protect the diaphragm and the pump against excessive reverse pressure differentials.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A diaphragm pump apparatus comprising:

a transfer chamber containing hydraulic fluid;

a pumping chamber for fluid to be pumped;

a control element extending to the transfer chamber;

a diaphragm connected to the control element, the diaphragm separating the transfer chamber and the pumping chamber; and a pressure protection device mounted to the control element, the pressure protection device being intermediate the control element and the diaphragm, the pressure protection device configured to seal against the transfer chamber when pressure differential across the diaphragm exceeds a predetermined value and form a smooth surface with a wall of the transfer chamber and provide continuous support to the diaphragm;

wherein the pressure protection device has a stiffness greater than a stiffness of the diaphragm.

2. A diaphragm pump apparatus according to claim 1, wherein the pump comprises a hydraulic housing and the pressure protection device comprises a ring type element engaging the hydraulic housing when subjected to the pressure differential.

3. A diaphragm pump apparatus according to claim 1, wherein the pressure protection device comprises a disk.

4. A diaphragm pump apparatus according to claim 1, wherein the pressure protection device comprises a flange.

5. A diaphragm pump apparatus according to claim 1, wherein the pressure protection device comprises a washer.

6. A diaphragm pump apparatus according to claim 1, wherein the pressure protection device comprises a molded ring.

7. A diaphragm pump apparatus according to claim 6, wherein the molded ring comprises a lip.

8. A diaphragm pump apparatus according to claim 1, wherein the pressure protection device mates with the transfer chamber while the pressure protection device deforms under differential pressure.

9. A diaphragm pump apparatus according to claim 1, wherein the pressure differential protection device comprises a ring type element configured to provide engagement with the hydraulic housing in a continuous support surface without gaps.

10. A pressure protection apparatus for a diaphragm in a diaphragm pump, the pump having a control element mounted to the diaphragm, a transfer chamber and a pumping chamber, the pressure protection apparatus comprising:

a pressure protection device mounted to the control element, the pressure protection device configured to seal against the transfer chamber when subjected to reverse differential pressure;

the pressure protection device being intermediate the control element and the diaphragm, the pressure protection device configured to seal against the transfer chamber of the diaphragm pump when pressure differential across the diaphragm exceeds a predetermined value and form a smooth surface with a wall of the transfer chamber and provide continuous support to the diaphragm;

wherein the pressure protection device has a stiffness greater than a stiffness of the diaphragm.

11. A pressure protection apparatus according to claim 10, wherein the pressure protection device supports the diaphragm on a transfer chamber side of the diaphragm.

12. A pressure protection apparatus according to claim 11, wherein the pressure protection device engages a wall of the transfer chamber.

13. A pressure protection apparatus according to claim 10, the control element comprising a plunger extending to the transfer chamber; wherein the pressure protection device is intermediate the plunger and the diaphragm.

14. A pressure protection device for a diaphragm according to claim 10, wherein the pressure protection device comprises a disk.

15. A pressure protection device for a diaphragm according to claim 10, wherein the pressure protection device comprises a flange.

16. A pressure protection device for a diaphragm according to claim 10, wherein the pressure protection device comprises a washer.

17. A pressure protection device for a diaphragm according to claim 10, wherein the pressure protection device comprises a molded ring.

18. A pressure protection device for a diaphragm according to claim 17, wherein the molded ring comprises a lip.

19. A pressure protection apparatus according to claim 10, wherein the pressure protection device mates with the transfer chamber while the pressure device deforms under differential pressure.

20. A pressure differential protection apparatus according to claim 10, comprising a ring type element configured to provide engagement with the hydraulic housing in a continuous support surface without gaps.

* * * * *